United States Patent [19]

Strelow

[11] 4,270,752

[45] Jun. 2, 1981

[54] REVERSER APPARATUS FOR TENNIS RACKETS

[76] Inventor: Edgar Strelow, Holsteinischer Kamp 64, 2000 Hamburg 76, Fed. Rep. of Germany

[21] Appl. No.: 27,814

[22] Filed: Apr. 6, 1979

[30] Foreign Application Priority Data

Oct. 7, 1978 [DE] Fed. Rep. of Germany ..... 2843824

[51] Int. Cl.[3] ..... A63B 51/41

[52] U.S. Cl. ..... 273/73 A

[58] Field of Search ..... 273/73 A; 73/145

[56] References Cited

U.S. PATENT DOCUMENTS 1,943,400 1/1934 Tauber et al. ..... 273/73 A
2,268,276 12/1941 Caro et al. ..... 273/73 A X

FOREIGN PATENT DOCUMENTS 485591 11/1929 Fed. Rep. of Germany ..... 273/73 A
532945 9/1931 Fed. Rep. of Germany ..... 273/73 A
146018 6/1936 Fed. Rep. of Germany ..... 273/73 A
488865 7/1938 United Kingdom ..... 273/73 A

*Primary Examiner*—Richard J. Apley
*Attorney, Agent, or Firm*—Toren, McGeady and Stanger

[57] ABSTRACT

A reverser apparatus for facilitating the cross stringing of tennis rackets to prevent the strings from frictional contact when pulling the cross strings through the longitudinally extending main strings, the apparatus comprising an in-line assembled plurality of similar members each with a string retainer, and actuator means for displacing, from an initial position in which all members are mutually aligned, every alternate member in one direction, and the members in between in an opposite direction. The members may include mating guide portions by which a member by its back side is slidably coupled to the front side of an adjacent member. The actuator means may consist of an actuator shaft bearing a plurality of eccenter cams. Between the members may be disposed spacers allowing to vary the mutual spacing of the members.

11 Claims, 8 Drawing Figures

REVERSER APPARATUS FOR TENNIS RACKETS

The present invention relates generally to the manufacture of tennis rackets and particularly to a reverser apparatus for stringing tennis rackets and more particularly to an apparatus for alternately raising and lowering portions of longitudinal strings stretching along a tennis racket frame to define weaving nest type clearances for introducing cross strings in the stringing of tennis racket frames.

When stringing tennis racket frames, there are initially inserted and tensioned the longitudinal strings in the frame. When the longitudinal strings have been tensioned, the cross strings are introduced so as to intersect the longitudinal strings at right angles whereby the cross strings are alternately disposed above and below the longitudinal strings. When introducing the cross strings, particular care must be taken not to touch the tensioned longitudinal strings when pulling through the cross strings since when pulling the cross strings through the longitudinal strings there may be generated friction at the points in which the strings touch each other, and this friction may cause damage to the strings. For this reason it is required to raise the longitudinal strings that stretch along the tennis racket frame in a manner so that the cross strings may be pulled therethrough without touching the longitudinal strings.

It is an object of the present invention to provide a reverser apparatus for tennis rackets, i.e. an apparatus for alternately raising and lowering portions of longitudinal strings stretching along a tennis racket frame to define weaving nest type clearances for introducing cross strings.

It is another object of the present invention to provide a reverser apparatus of the stated type which apparatus may be adapted to the actual number of longitudinal strings stretching along a tennis racket frame and which apparatus may be readily applied to a larger or a smaller number of extended longitudinal strings, without requiring any specialized or additional devices, and which apparatus allows an adaptation to the spacing width between any two longitudinal strings.

For achieving these objects, there is now proposed an apparatus of the type set forth in the beginning of the present specification which apparatus in accordance with the present invention comprises a plurality of discrete plate-shaped support bodies arranged in a line one behind the other, being releasably assembled and adapted for alternate sliding movement in a direction transversely of the longitudinal direction of the apparatus, by means of an actuator shaft and operating means such as a crank drive, eccenter gears, gearing or the like, in a manner to raise every second support body and to lower the support bodies disposed in between the raised support bodies, every discrete support body including a gripping arm with string retainer means.

By means of an apparatus of this type, it is readily possible to effect the alternate raising and lowering of portions of longitudinal strings extending under tension along a tennis racket frame to define weaving nest type clearances for introducing the cross strings. Since the apparatus comprises discrete support bodies adapted to be assembled and having gripping arms with string retainer means, the apparatus may be adapted to a given number of longitudinal strings. Additionally, proper raising and lowering of the longitudinal strings is likewise possible in the end regions of tennis racket frames, and this is achieved by reducing the number of discrete support bodies. Since the support bodies with the gripping arms for the longitudinal strings are arranged on a common actuator shaft, it is possible to adapt the spacing of the individual support bodies to the spacing of the individual longitudinal strings. When operating the actuator shaft correspondingly, every second or alternate support body will be raised or lowered whereas the intermediate support bodies will be moved in the respective opposite direction so that by correspondingly raising and lowering of the longitudinal strings stretching along a tennis racket frame there may be defined clearances that correspond to a weaving nest in weaving so that cross strings may be introduced through these clearances without touching the longitudinal strings.

Further advantageous embodiments of the present invention are recited in the sub-claims. In a particularly advantageous embodiment are arranged, between the support bodies, spacers forming longitudinal string spacing adapter means so that the spacings between the support bodies may be adapted to the spacings between the longitudinal strings.

In the drawings, the subject matter of the invention is illustrated by means of embodiments wherein FIG. 1 is a lateral elevational view of a longitudinal string raising and lowering apparatus according to the present invention consisting of several in-line discrete support bodies with gripping arms for the strings;

Figure 1:
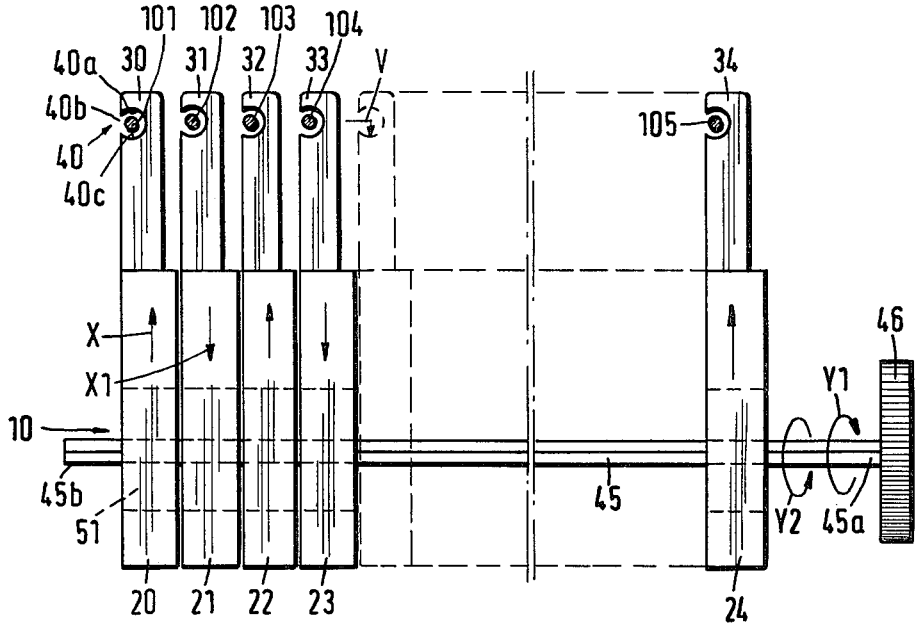

The apparatus of the invention for alternately raising and lowering portions of longitudinal strings 101, 102, 103, 104 and 105 stretching along a tennis racket frame 100 is indicated in FIG. 1 generally by the reference numeral 10 and comprises several discrete support bodies 20, 21, 22, 23, 24 arranged in a line one behind the other. The support bodies are mutually assembled in a manner allowing alternate displacements in a direction transversely of the longitudinal direction of the apparatus. In FIG. 1 are shown five support bodies 20 to 24 whereby a certain number of further support bodies arranged between the two support bodies 23 and 24 is not shown. This is to say that the number of support bodies is optional; it will depend upon the number of longitudinal strings stretching along a tennis racket frame 100.

Every support body 20 to 24 consists of a plate-shaped member 20*a* of a rectangular, circular or square configuration. The member 20*a* of every support body may also be of another geometrical configuration. Since all support bodies 20 to 24 are of the same design, the support body 20 will be described more in detail in the following.

Figure 3:
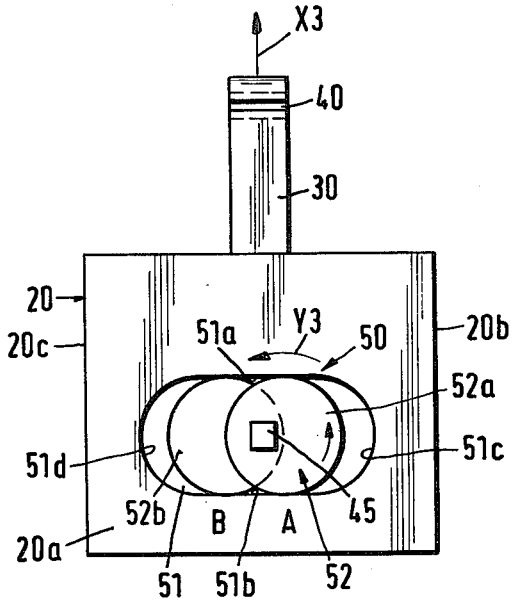
FIG. 3 is a front elevational view of a support body with an operating means.

The support body 20 includes in its upper region a gripping arm 30 of a rod-like configuration. This gripping arm 30 extends centrally from the member 20*a* of the support body 20. The member 20*a* and the gripping arm 30 are integral. An assembly of several parts is likewise possible. The gripping arm 30 will then be connected to the member 20*a* by means of screw or adhesive fasteners (FIGS. 1 and 3).

Figure 2:
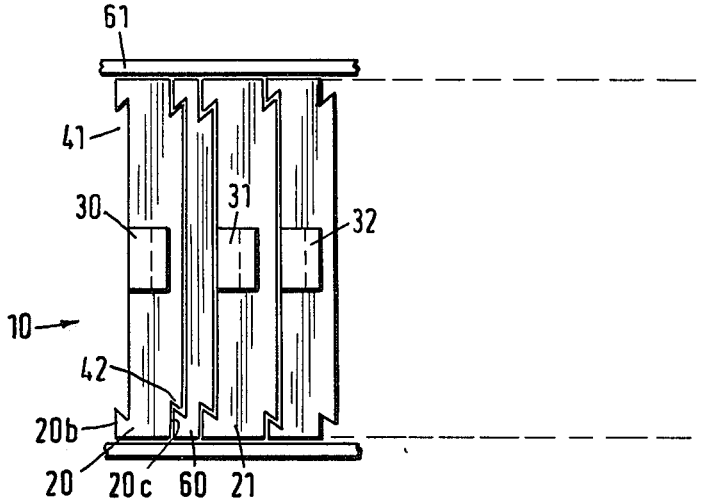
FIG. 2 is a top view of several support bodies of the apparatus in an embodiment in which is arranged a spacer disc intermediate two support bodies.

The member 20*a* of the support body 20 furthermore includes integral front and rear guide elements which in the embodiment shown in FIG. 2 consist of dovetail guide grooves 41 and mating profiles 42 of a corresponding configuration. The support body 20 includes in the region of its front surface 20*b* the dovetail guide groove 41 whereas the back surface 20*c* of the member 20*a* of the support body 20 includes the mating profile 42 of the corresponding configuration so that this mating profile 42 engages the guide groove 41 of the support body next in line (FIG. 2). These guide elements 41, 42 are arranged on every support body in a direction transversely of the longitudinal direction of the apparatus and perpendicularly so that by means of these guide elements the individual support bodies 20 to 24 may be slidably displaced with respect to each other transversely of the longitudinal direction of the apparatus and in the directions of the arrows x and $x_1$ (FIG. 1). The guide elements 41, 42 concurrently serve to mutually mount the individual support bodies 20 to 24 so that a desired number of support bodies may be readily assembled in a line. Instead of the above described guide elements 41, 42 as shown in FIG. 2, there may also be provided guide elements of a different design. If for example all support bodies 20 to 24 are assembled by a peripheral frame 61, then the guide elements may be provided at the narrow surfaces of every support body 20 to 24 whereas the corresponding mating profiles may then be arranged at the mutually facing wall surfaces of the frame 61. The individual support bodies 20 to 24 are then slidably movable with respect to each other within the frame 61 (FIG. 2). In order to ensure that likewise in this embodiment there may be employed a desired number of support bodies 20 to 24, the frame 61 is of a design allowing shortening or extending by employing corresponding modules with plug connectors.

The gripping arm 30 of the support body 20 is provided in its upper region with string retainer means 40 in the form of an approximately circular recess 40*a* extending transversely of the longitudinal direction of the apparatus and being accessible externally. This recess 40*a* may also be of a different geometrical configuration. The recess 40*a* must, however, be always designed so as to include a section 40*c* which is lower than the entry opening 40*b* in the front wall of the gripping arm 30. Upon introducing a longitudinal string in the direction of the arrow y, the longitudinal string will be received in this lower section 40*c* of the gripping arm 30 so that when slidably displacing the support bodies 20 to 24 the longitudinal strings retained in the string retainers 40 may not escape by sliding out in lateral direction.

All gripping arms 30, 31, 32, 33 and 34 of the support bodies 20 to 24 are of identical design and include identical string retainers 40. The entry openings 40*b* of the recesses 40*a* in the gripping arms 30 to 34 all extend in one direction, in order to allow simultaneous introduction of the longitudinal strings into the recesses 40*a* of the gripping arms 30 to 34 of the support bodies 20 to 24 (FIG. 1).

For allowing relative sliding movement of the support bodies 20 to 24 so as to raise every second support body whereas the respective intermediate support bodies are in a lowered position, every support body 20 to 24 is provided with operating means 50.

In the embodiment shown in FIG. 3 the operating means 50 includes an elongate hole 51 in the member 20*a* of the support body, the elongate hole extending transversely of the longitudinal direction of the apparatus. The elongate hole 51 is delimited by two opposing and parallel sections 51*a* and 51*b* which merge at their ends into arcuate portions 51*c* and 51*d*. Within this elongate hole 51 is held and guided an eccenter disc 52 which is mounted on an actuator shaft 45. All other support bodies 21 to 24 are arranged identically to the above described design of the support body 20 shown in FIG. 3. Merely the arrangement of the eccenter discs 52 of the individual support bodies 20 to 24 is mutually different. The eccenter discs 52 of all support bodies 20 to 24 are arranged on the common actuator shaft 45 which extends from the overall apparatus 10 at one end or at both ends and mounts at one of its ends an actuator wheel 46 or mounts actuator wheels at both ends. Instead of employing an actuator wheel 46, the free end or both free ends 45*a* and 45*b* of the actuator shaft 45 may be arranged in the form of a crank so that by operating the crank or the actuator wheel 46 the actuator shaft 45 may be rotated either in the direction of arrow $y_1$ or in the direction of arrow $y_2$. The actuator shaft 45 concurrently serves to support and mount all support bodies 20 to 24. Advantageously, the actuator shaft 45 is of a square cross-section. The eccenter discs 52 of the individual support bodies 20 to 24 are then provided with apertures of a corresponding configuration through which the actuator shaft 45 may be inserted. Because of this design of the actuator shaft 45 a special attachment of the eccenter discs 52 to the actuator shaft 45 is not required. The apertures in the eccenter discs 52 for inserting the actuator shaft 45 are thereby sized so that the eccenter discs 52 will be retained by press fit on the actuator shaft 45.

Figure 4:
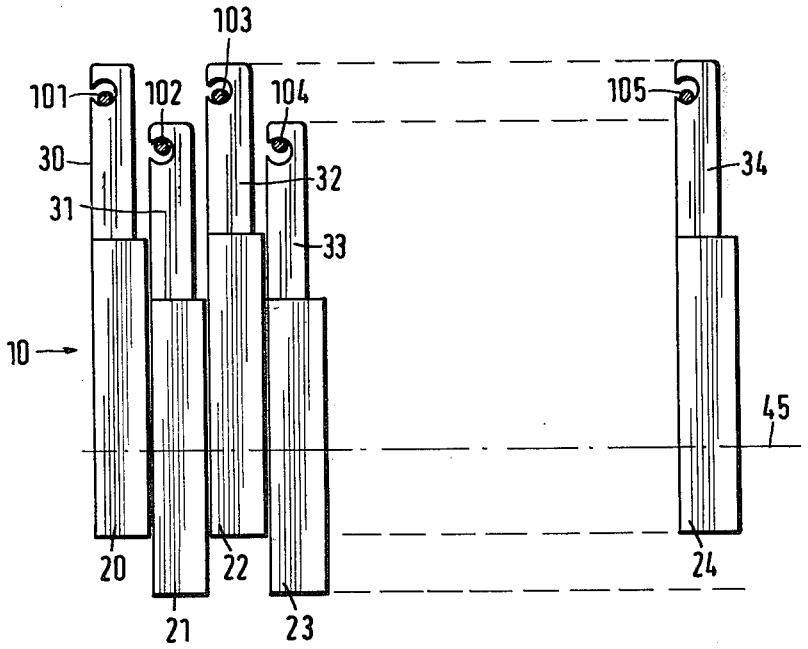
FIG. 4 is a lateral view of the apparatus with support bodies extended into the longitudinal string tensioning position.
Figure 7:
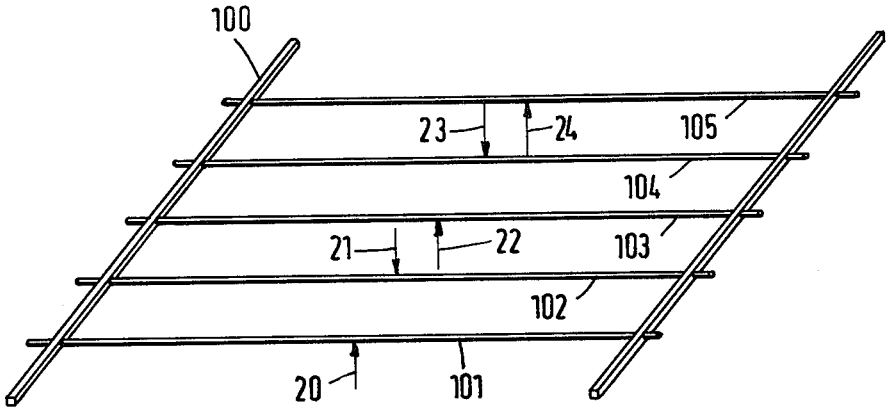
FIGS. 7 and 8 are respectively schematical perspective views illustrating the application of the apparatus to longitudinal strings tensioned in a tennis racket frame in the normal position of the apparatus and with raised and lowered longitudinal strings.
Figure 8:
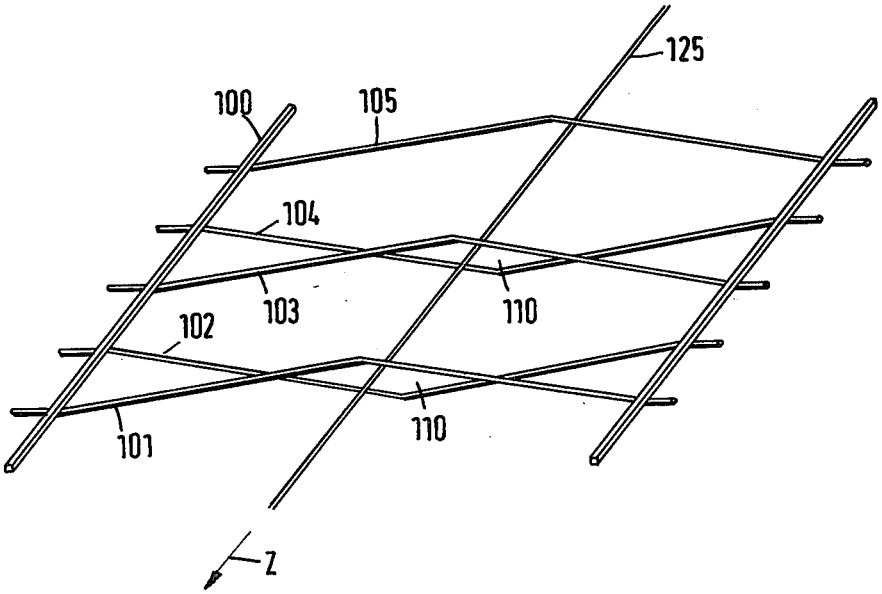

For allowing mutual sliding displacement of the support bodies 20 to 24 the individual support bodies with their eccenter discs 52 are arranged as follows: As shown in FIG. 3, the actuator shaft 45 is arranged in a position approximately centrally of the elongate hole 51. The eccenter disc 52 of the support body 20 is arranged so that the larger portion 52*a* of the disc faces the outer edge 20*b* of the member 20*a* of the support body 20. The support body 21 next in line to the support body 20 is arranged with respect to its eccenter disc on the actuator shaft 45 and within the hole 51 so that the larger portion 52*b* of the eccenter disc faces the other outer edge 20*c* of the member 20*a* of the support body 20. The eccenter disc 52 of the support body 20 thus assumes the position A shown in FIG. 3 whereas the eccenter disc of the support body 21 next in line to body 20 assumes the position indicated at B. The support body 22 which in turn is next in line to the support body 21 is again in an eccenter disc position that corresponds to the position of the eccenter disc 52 of the support body 20. In this manner the eccenter discs 52 of the first support body 20 and the eccenter discs of every second support body 22, 24 assume the position A shown in FIG. 3 whereas the eccenter discs of the respective intermediate support bodies 21 and 23 assume the position B. When now rotating the actuator shaft through 90° in the direction of the arrow $y_3$ of FIG. 3, the larger portion 52*a* of the eccenter disc 52 likewise rotates in the direction of the arrow $y_3$, and due to the positive guidance of the eccenter disc 52 within the elongate hole 51 the whole support body 20 will be moved upwardly in the direction of the arrow $x_3$. When rotating the actuator shaft 45 through 90° in the direction of the arrow $y_3$, the eccenter discs of all other support bodies will likewise be moved. By the different arrangement of the eccenter disc of the support body 21 next in line to the support body 20, the larger portion 52*b* of the eccenter disc of the support body 21 is likewise moved in the direction of the arrow $y_3$ so that because of this positive guidance of this eccenter disc in the corresponding elongate hole of the support body 21 there will be effected a movement by which the support body 21 is moved downwardly. The overall movement resulting from rotation of the actuator shaft 45 is shown in FIG. 4. As may be seen, the support bodies 20, 22 and 24 assume an upper position whereas the other support bodies 21 and 23 assume a lowered position. The longitudinal strings 101, 102, 103, 104, 105 will then have been moved from the basic or initial position shown in FIGS. 1 and 7 in which the gripping arms 30 to 34 are inserted into the longitudinal strings 101 to 105 into the position shown in FIG. 4 whereby the longitudinal strings 101, 103, 105 are raised whereas the longitudinal strings 102 and 104 are lowered (FIG. 8). In this position of the longitudinal strings 101 to 105 will be defined, between the raised and lowered longitudinal strings, a clearance 110 which corresponds to a weaving nest in weaving. Through this clearance the cross string 125 may be introduced in the direction of the arrow z, without touching the longitudinal strings. When the cross string 125 has been passed therethrough and has simultaneously been extended through the frame beams, the actuator shaft 45 will again be rotated through further 90° with the result that the support bodies 21 and 23 will be moved from the lowered position shown in FIG. 4 into the raised position whereas the remaining support bodies 20, 22 and 24 are lowered, with the result that the longitudinal strings 102 and 104 are raised and the longitudinal strings 101, 103 and 105 are lowered. In this position of the longitudinal strings 101 to 105 will be formed anew a clearance 110 so that the cross string 125 extended in the first run may be passed through this new clearance, with the results that there will be obtained an intercepting string system in which the cross strings lie alternately above and below the longitudinal strings.

Instead of the above described and illustrated operating means 50 there exists likewise the possibility of employing operating means of a different design for the alternate displacement of the individual support bodies 20 to 24. Thus, it is possible to arrange the operating means in the form of a crank drive or gearing. When employing gearing, the individual support bodies 20 to 24 will be provided in the region of one of their two longitudinal sides with a respective tooth rack the teeth of which engage the teeth of a pinion which is arranged jointly with all other pinions of the respective support bodies on an actuator shaft. By correspondingly arranged intermediate gears it is possible to move, upon actuation of the axis, part of the support bodies upwardly and the other part of the support bodies downwardly.

The dimensions and particularly the width of each support body 20 to 24 are selected so that every string retainer 40 in the individual gripping arms 30 to 34 of the support bodies 20 to 24 will be associated with a longitudinal string. Since the spacings between the longitudinal strings stretching along a tennis racket frame may vary from one type of tennis racket to another racket, there is provided, in accordance with a further embodiment of the present invention, the arrangement of spacer discs 60 between every pair of support bodies 20 and 21. In adaptation to the spacings between two longitudinal strings correspondingly dimensioned spacer discs may be provided as spacers between the individual support bodies whereby these spacer discs 60 are provided with a corresponding guide profile that is similar to the one of the individual support bodies so that the spacer discs 60 and the support bodies 20 to 24 may be readily assembled by a module type assembly operation. By guide elements of this type the spacer discs 60 may be connected to the support bodies (FIG. 2). Every spacer disc 60 may consist of two plate-shaped members the outer wall surfaces of which are then provided with corresponding guide elements into which engage the guide elements of the next adjacent support bodies in front and behind. When every spacer disc 60 consists of two plate-shaped parallel arranged members, then it is possible to vary the mutual spacing of the two members, for example by means of spindle type screw elements so that the adjustment of the desired spacings between two support bodies will be possible without having recourse to several spacer discs of different thicknesses. The spacer discs 60 are provided with corresponding apertures through which the actuator shaft 45 may extend. It is likewise possible to extend the spacer discs 60 at their bottom and to interconnect the extended portions by a mounting plate so that the spacer discs 60 are rigidly interconnected whereas the support bodies respectively arranged intermediate two spacer discs may be slidably moved in vertical direction.

The invention is not restricted to the above described embodiments shown in the appended drawings. Different configurations and arrangements of the support bodies should be considered to be within the scope of the invention just as well as operating means of a different design but of an equivalent operation for the vertical displacement of the individual support bodies.

The support bodies 20 to 24 with their gripping arms 30 to 34 and the eccenter discs 52 are made of hard plastic materials or other suitable materials. By module type addition or removal of individual support bodies may be provided an apparatus having a number of gripping arms for the individual longitudinal strings corresponding to the number of longitudinal strings stretching along a tennis racket frame. The apparatus 10 may be manufactured economically since the individual support bodies are of the same design. When the support bodies are provided with an elongate hole and an eccenter disc as operating means, the overall apparatus comprises merely three members, i.e. a support body with an eccenter disc and an actuator shaft.

Figure 5:
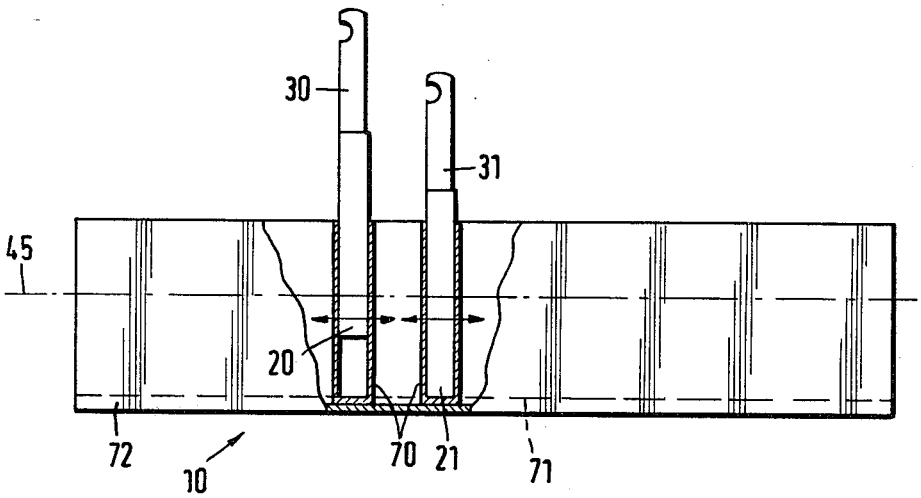
FIG. 5 is a lateral view of another embodiment of the apparatus according to the invention wherein the size of the interstices between the individual support bodies may be varied.

In the embodiment shown in FIG. 5 every support body 20 to 24 is arranged in a pocket type mounting 70 in which the support body is retained so as to be slidably displaceable within the inner space of the mounting 70 by rotating the actuator shaft 45. The mutually opposing walls of every mounting 70 include apertures for passing therethrough the actuator shaft 45. The mountings 70 are retained in a frame 72 by means of guides 71 and are slidably movable in the horizontal direction so as to vary the spacing between two support bodies. In this manner it is possible to readily adapt the support bodies 20 to 24 to the actual spacing of two tennis racket longitudinal strings. By means of set screws or the like the mountings 70 may be locked in the individual positions.

Figure 6:
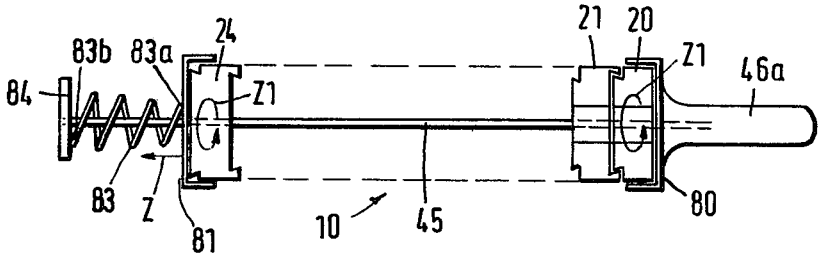
FIG. 6 is a top view of an apparatus in which the number of active support bodies may be varied.

Since the tennis racket frames taper toward their end regions, it will be required to operate with a lesser number of support bodies 20 to 22 in the racket end regions. As shown in FIG. 6, the support bodies 20 to 24 are maintained between two end mountings 80, 81 which are arranged on the actuator shaft 45 without interfering with the free movability of the actuator shaft 45. The end mounting 80 is delimited on the actuator shaft 45 by the grip type handle 46*a* whereas the other end mounting 81 is biased by a resilient element such as a spring or the like 83 which engages by its one end 83*a* the end mounting 81, and by its opposite end 83*b* a limit disc 84. The limit disc 84 is arranged on the actuator shaft 45 on the end thereof.

If the overall apparatus consists for example of sixteen support bodies and when for the tennis racket frame end regions only fourteen support bodies are required, the end mounting 81 will be urged against the spring 83 in the direction of the arrow z so that the first support body and the last support body will be no longer gripped by the end mountings 80, 81. These two support bodies will then be rotated through 180° in the direction of the arrow $z_1$ so that the gripping arms of these support bodies point downwardly. An apparatus which is reduced by this number of support bodies may therefore likewise be employed in the tennis racket end regions.

What is claimed is:

1. In a device for stringing tennis rackets, said rackets being strung with longitudinally extending strings and cross strings, apparatus for alternately raising and lowering the longitudinal strings strung in a frame of said racket in order to provide spaces therebetween for insertion of said cross string, said apparatus comprising: a plurality of planar support bodies arranged in alignment adjacent each other in interfacing relationship to enable relative movement therebetween in directions extending transversely to said longitudinal strings; string holding devices arranged on each of said support bodies for engaging said longitudinal strings to enable said string to be alternately moved out of a common plane by movement of said support bodies; wall means defining an oblong hole extending through each of said support bodies, with the oblong holes of each of said support bodies being adapted to be placed in general alignment with each other when said plurality of support bodies are arranged in alignment adjacent each other; and actuator means for alternately moving adjacent support bodies in opposed directions in order to alternately separate longitudinal strings engaged in said string holding devices, said actuator means comprising a plurality of discs eccentrically mounted relative to a common axis of rotation, each of said discs being engaged with an oblong hole of one of said support bodies in engaging relationship with said wall means to effect said alternate movement of adjacent support bodies in opposed directions upon rotation of said discs about said common axis.

2. Apparatus according to claim 1 wherein said support bodies comprise means for effecting sliding interengagement therebetween.

3. Apparatus according to claims 1 or 2 wherein each of said support bodies is formed with facing planar surfaces which are maintained parallel relative to each other during sliding relative movement of said support bodies by said means for effecting sliding interengagement therebetween.

4. Apparatus according to claim 2 wherein said means for effecting sliding interengagement between said support bodies comprise dove tail guide grooves formed as guide elements arranged for mating sliding interengagement.

5. Apparatus according to claim 1 further comprising spacer means located between said support bodies to effect a desired separation of said string holding devices.

6. Apparatus according to claim 5 wherein said spacer discs are arranged in sliding interengagement with adjacent support bodies.

7. Apparatus according to claim 1 further comprising a peripheral frame within which said support bodies are slidably mounted in guided engagement.

8. Apparatus according to claim 1 further comprising casing means within which said support bodies are slideably mounted for movement parallel to each other, and a frame having said casing means supported therein.

9. Apparatus according to claim 1 wherein said plurality of eccentric discs is mounted upon an actuator shaft extending along said common axis, and adapted to be rotated to effect rotation of said eccentric discs.

10. In apparatus for alternately raising and lowering portions of longitudinal strings stretching along a tennis racket frame to define weaving nest type clearances for introducing cross strings in the stringing of tennis racket frames, the improvement comprising a plurality of discrete planar support bodies arranged in a line one behind the other and being releasably assembled and adapted for alternate sliding movement in directions transversely of the longitudinal direction of said apparatus, an actuator shaft and eccentric operating means operative to raise every second support body and to lower the support bodies disposed between the raised support body, with each support body including a gripping arm with string retainer means, said support bodies including guide elements for relative displacement at mutually facing surfaces, said guide elements being formed as dove tail guide grooves on one side and in the form of mating profiles on the other side, said mating profiles being adapted to engage the guide grooves of the respective adjacent support body.

11. Apparatus according to claim 10 wherein said gripping arms of each support body include a circular recess in the vicinity of the free end of said gripping arm, said recess being laterally accessible and extending in a direction transversely of the longitudinal direction of said apparatus and serving as a string retainer.

* * * * *